US008584628B2

(12) United States Patent
Brewer et al.

(10) Patent No.: US 8,584,628 B2
(45) Date of Patent: Nov. 19, 2013

(54) ENGINE WITH CYLINDER HEAD COOLING

(75) Inventors: Todd Jay Brewer, Dearborn, MI (US); John Christopher Riegger, Ann Arbor, MI (US); Dennis G. Barbier, Washington, MI (US); Jeff D. Fluharty, Woodhaven, MI (US); Jody Michael Slike, Farmington Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 434 days.

(21) Appl. No.: 12/835,988

(22) Filed: Jul. 14, 2010

(65) Prior Publication Data

US 2012/0012073 A1 Jan. 19, 2012

(51) Int. Cl.
*F02B 75/20* (2006.01)

(52) U.S. Cl.
USPC ..... 123/41.82 R; 123/193.5

(58) Field of Classification Search
USPC ..... 123/41.82 R, 193.5
See application file for complete search history.

(56) References Cited

U.S. PATENT DOCUMENTS

| | | | |
|---|---|---|---|
| 4,759,181 | A | 7/1988 | Biritz |
| 4,860,700 | A | 8/1989 | Smith |
| 6,295,963 | B1 | 10/2001 | Kollock et al. |
| 8,061,131 | B2 | 11/2011 | Kuhlbach |
| 2004/0040521 | A1 | 3/2004 | Hardin |
| 2005/0193966 | A1 | 9/2005 | Mac Vicar et al. |
| 2007/0215074 | A1 | 9/2007 | Rozario et al. |
| 2009/0126659 | A1 | 5/2009 | Lester et al. |

FOREIGN PATENT DOCUMENTS

DE 102008051130 A1 4/2010

*Primary Examiner* — Noah Kamen
(74) *Attorney, Agent, or Firm* — Julia Voutyras; Alleman Hall McCoy Russell & Tuttle LLP

(57) ABSTRACT

A cylinder head for an engine is provided. The cylinder head may include an upper cooling jacket including at least a first inlet and a first outlet and a lower cooling jacket including at least a second inlet and a second outlet. The cylinder head may further include a first set of crossover coolant passages including one or more crossover coolant passages fluidly coupled to the upper cooling jacket and the lower cooling jacket and adjacent to one or more combustion chambers.

20 Claims, 12 Drawing Sheets

ENGINE WITH CYLINDER HEAD COOLING

BACKGROUND/SUMMARY

Cooling jackets enable heat to be extracted from the cylinder head of an internal combustion engine. Two piece water jackets have been designed to increase the amount of heat that can be removed from the cylinder head to improve engine performance.

A cylinder head including a two-piece water jacket is disclosed in U.S. Pat. No. 7,367,294. Two embodiments of a coolant flow path are shown. In a first embodiment the coolant flows through the two water jackets in a series configuration in which coolant is directed from the outlet of the lower cooling jacket to the inlet of the upper cooling jacket. In a second embodiment coolant flow through the two water jackets in a parallel configuration (i.e., only the inlet and outlet of both the cooling jackets are fluidly coupled).

However, the inventors herein have recognized various shortcomings of the above approaches. The series, or parallel, coolant flow paths may increase the thermal variability within the cylinder head, which may increase the thermal stress on the cylinder head and in some cases cause the cylinder head to warp while the engine is cooling down. Moreover, the two-piece water jacket design disclosed in U.S. Pat. No. 7,367,294 may have a decreased structural integrity due to the design (e.g., layout, shape, etc.) of the coolant passages in the cylinder head. Furthermore, excess gas may build up in the cooling system disclosed in U.S. Pat. No. 7,367,294 degrading cooling operation.

As such, various example systems and approaches are described herein. In one example, a cylinder head for an engine is provided. The cylinder head may include an upper cooling jacket including at least a first inlet and a first outlet and a lower cooling jacket including at least a second inlet and a second outlet. The cylinder head may further include a first set of crossover coolant passages including one or more crossover coolant passages fluidly coupled to the upper cooling jacket and the lower cooling jacket and adjacent to one or more combustion chambers. In this way, it is possible to generate a mixed flow pattern within the cylinder head that is conducive to reducing thermal variability and increasing cooling within the cylinder head and surrounding components while retaining a desired amount of structural integrity.

Vapor may develop in the cooling jackets due to the elevated temperatures in the cooling jackets during engine operation. When vapor is present in the cooling jackets the heat transfer rate from the cylinder head to the coolant may be decreased due to the decreased heat capacity of the vapor when compared to the liquid coolant, thereby degrading cooling operation. Therefore in some examples the cylinder head may include a de-gas port configured to remove gas from the upper cooling jacket, the de-gas port may be positioned in an area adjoining an upper surface of the upper cooling jacket. In this way, gases may be removed from the upper cooling jacket increasing the amount of heat that may be transferred to the coolant from the cooling jackets, thereby improving cooling operation.

In another example a method for operation of a cooling system in an internal combustion engine is provided. The method including flowing coolant into an inlet of an upper cooling jacket from a coolant passage in a cylinder block and flowing coolant into an inlet of a lower cooling jacket from the coolant passage in the cylinder block. The method further includes flowing coolant between the upper and lower cooling jackets via a crossover coolant passage fluidly coupling the upper and lower cooling jackets, the crossover coolant passages positioned downstream of the inlet of the upper and lower cooling jacket and upstream of the outlets of the upper and lower cooling jackets. In this way, it is possible to generate a mixed coolant flow pattern within the cylinder head, thereby decreasing thermal variability within the cylinder head.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

A cylinder head for an engine is disclosed herein. The cylinder head includes cross-over cooling passages for flowing coolant between an upper and a lower cooling jacket. In some examples, the crossover coolant passages may be vertically aligned and adjacent to one or more combustion chambers included in the engine. The cross-over coolant passages may generate a mixed coolant flow pattern within the cylinder head in which coolant travels between the cooling jackets at various points between the inlets and the outlets of both the upper and lower cooling jackets. The mixed flow pattern of the coolant in the cylinder head allows the thermal variability within the cylinder head and surrounding components to be decreased as well as reduces the thermal stresses on the cylinder head during engine warm-up and cool down.

Figure 1:
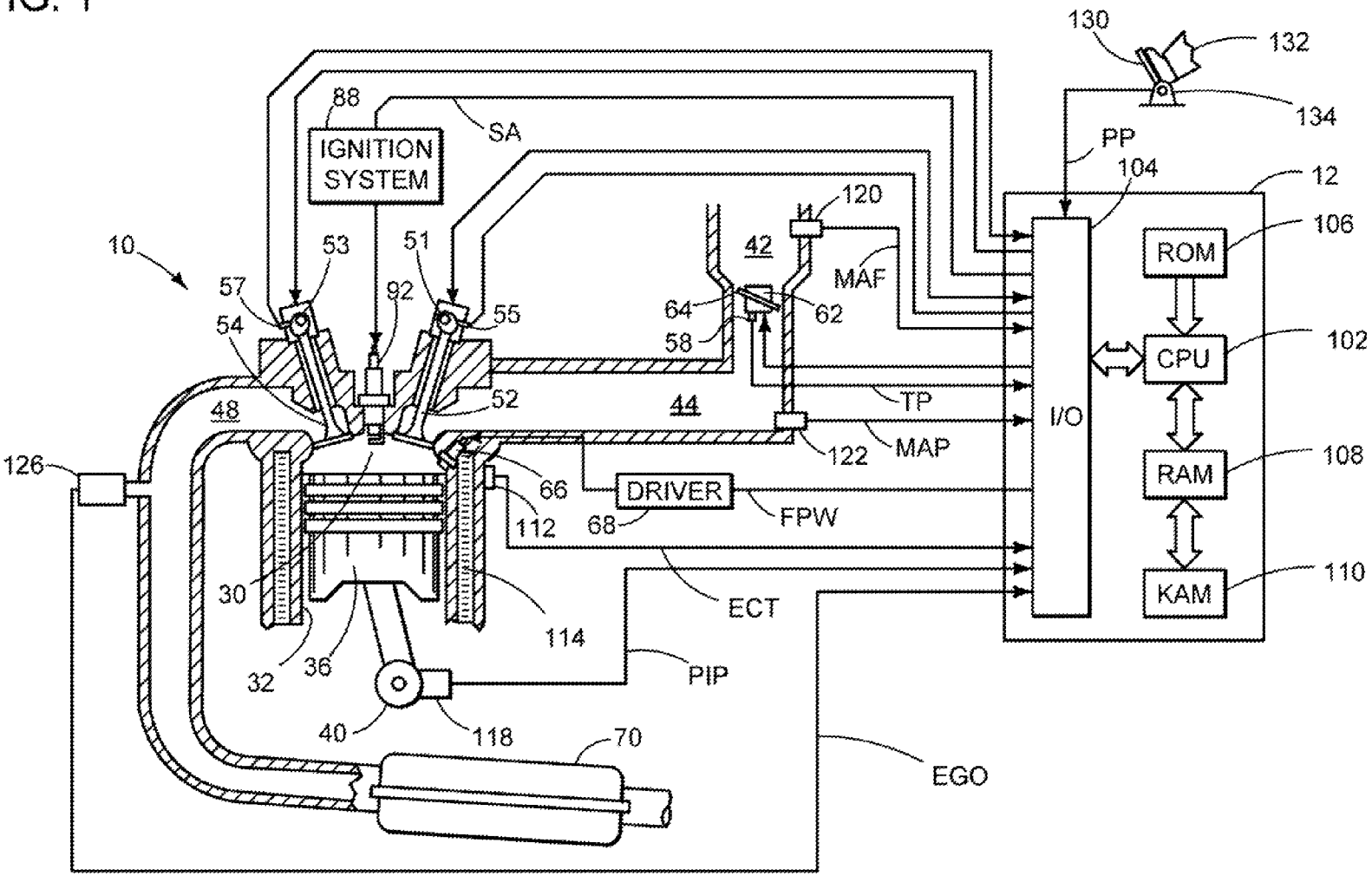
FIG. 1 shows a schematic depiction of an engine.
Figure 2:
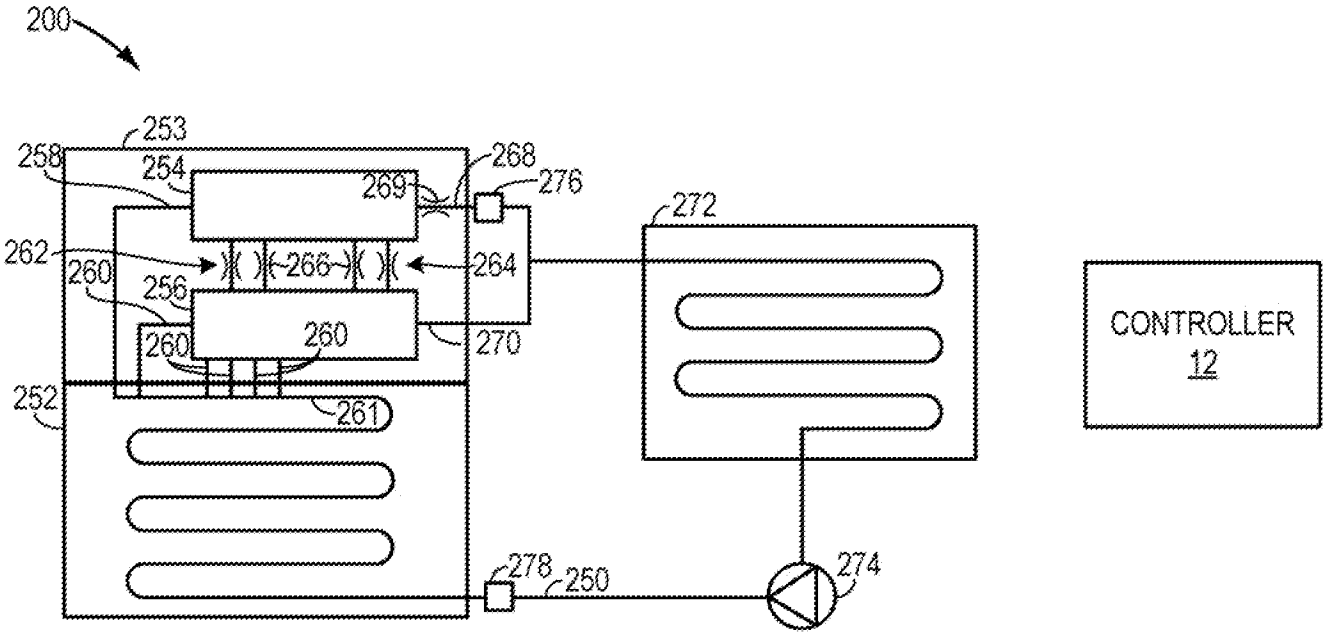
FIG. 2 shows a schematic depiction of a cooling system that may be included in the engine shown in FIG. 1.
Figure 15:
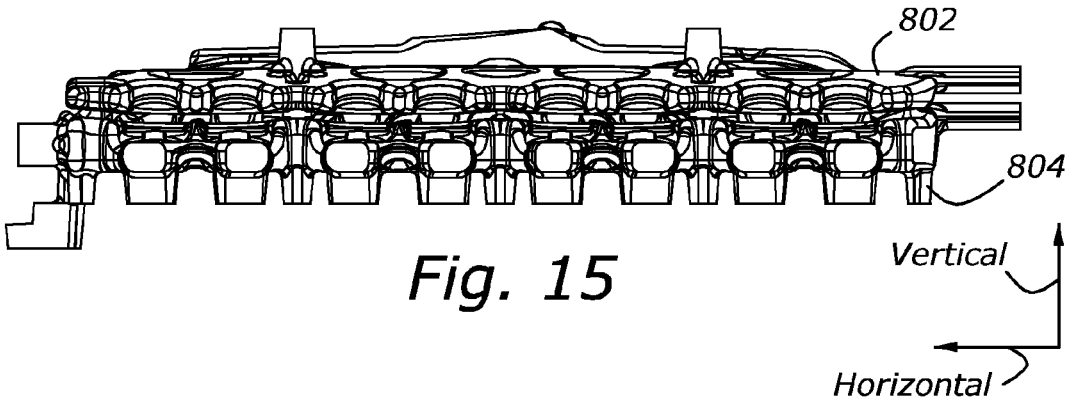
Figure 16:
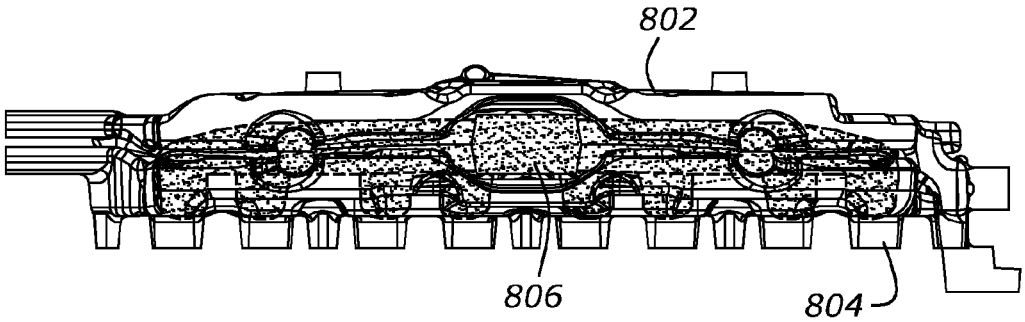
Figure 17:
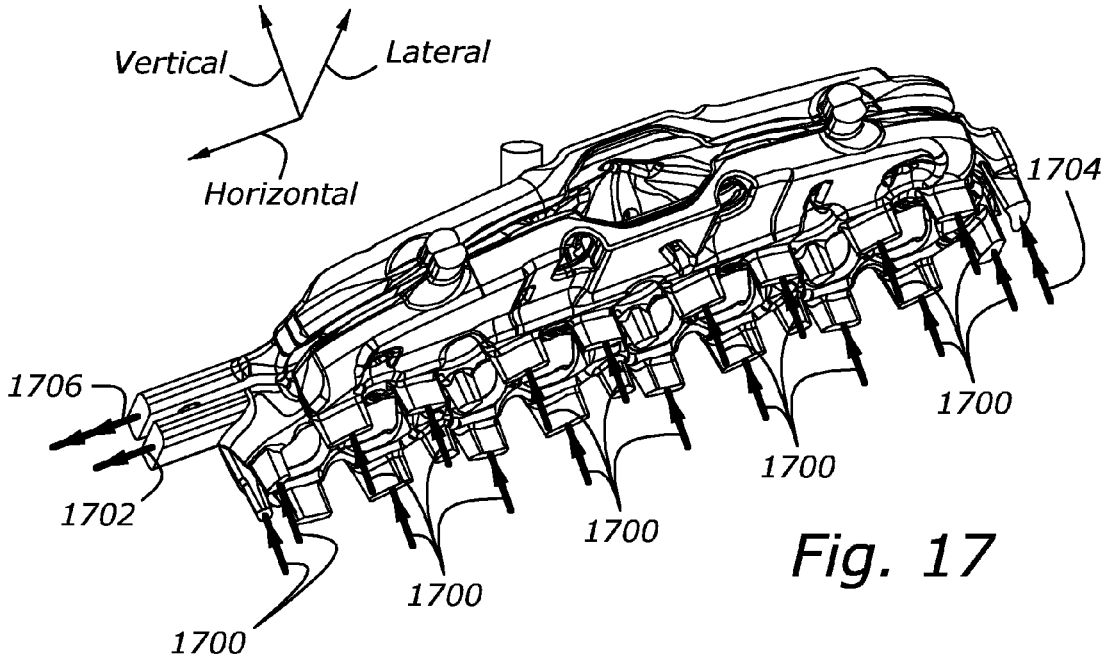
FIGS. 17-19 depict the flow path of coolant through the upper and lower cooling jackets included in the cylinder head shown in FIG. 3 drawn approximately to scale.
Figure 18:
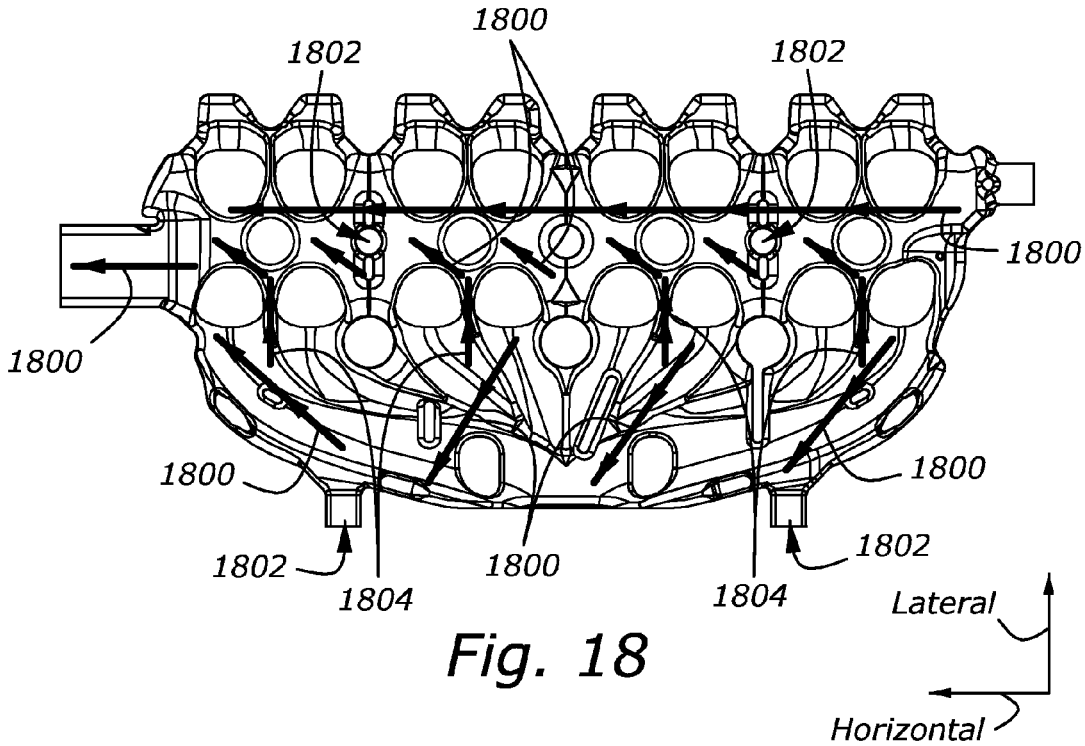
Figure 19:
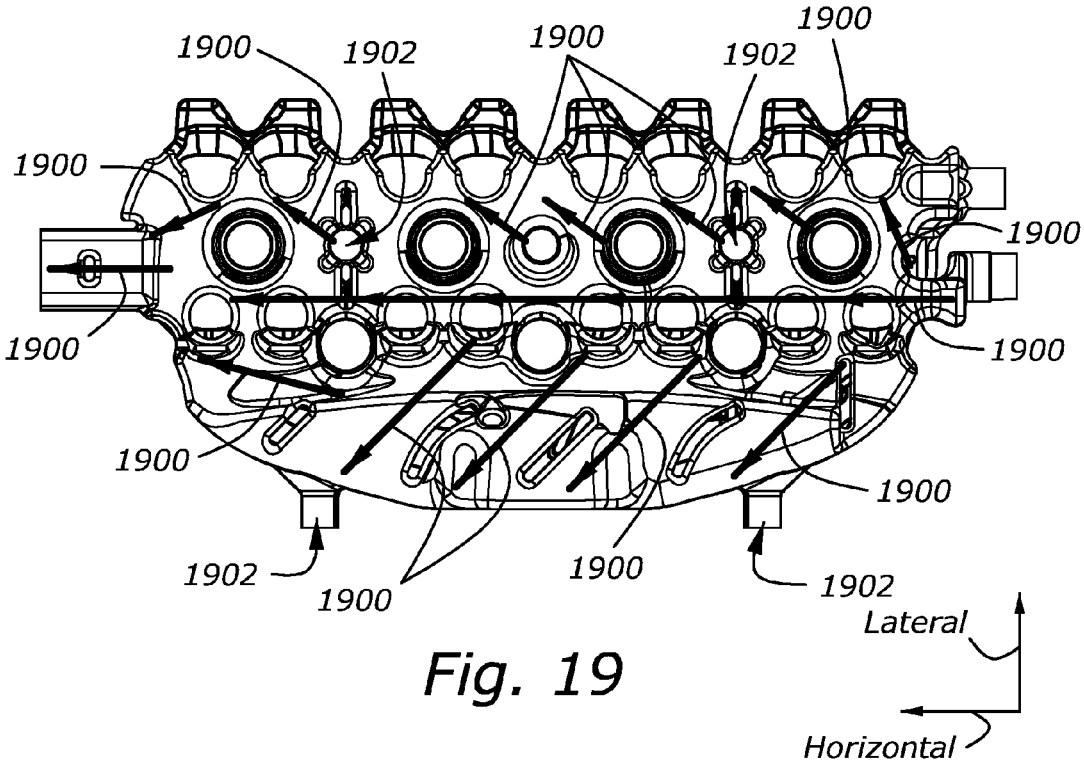

FIGS. 1 and 2 show schematic depictions of an engine and corresponding cooling system. FIGS. 3-7 show various views and cross-sections of an example cylinder head that may be included in the cooling system shown in FIG. 2. FIGS. 8-16 show various views and cross-sections of the cores prints that may be used to cast the cylinder head shown in FIGS. 3-7. Furthermore, FIGS. 17-19 show the flow path of the coolant through the cylinder head shown in FIGS. 3-7 and FIG. 20 shows a method for operation of a cooling system in an engine. Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57.

Intake manifold 44 is also shown intermediate of intake valve 52 and air intake zip tube 42. Fuel is delivered to fuel injector 66 by a fuel system (not shown) including a fuel tank, fuel pump, and fuel rail (not shown). The engine 10 of FIG. 1 is configured such that the fuel is injected directly into the engine cylinder, which is known to those skilled in the art as direct injection. Fuel injector 66 is supplied operating current from driver 68 which responds to controller 12. In addition, intake manifold 44 is shown communicating with optional electronic throttle 62 with throttle plate 64. In one example, a low pressure direct injection system may be used, where fuel pressure can be raised to approximately 20-30 bar. Alternatively, a high pressure, dual stage, fuel system may be used to generate higher fuel pressures. Still in alternate embodiments a port injection system may be used.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by foot 132; a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; and a measurement of throttle position from sensor 58. Barometric pressure may also be sensed (sensor not shown) for processing by controller 12. In a preferred aspect of the present description, Hall effect sensor 118 produces a predetermined number of equally spaced pulses every revolution of the crankshaft from which engine speed (RPM) can be determined.

In some embodiments, the engine may be coupled to an electric motor/battery system in a hybrid vehicle. The hybrid vehicle may have a parallel configuration, series configuration, or variation or combinations thereof.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. However in other examples compression ignition may be utilized. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

In one embodiment, the stop/start crank position sensor has both zero speed and bi-directional capability. In some applications a bi-directional Hall sensor may be used, in others the magnets may be mounted to the target. Magnets may be placed on the target and the "missing tooth gap" can potentially be eliminated if the sensor is capable of detecting a change in signal amplitude (e.g., use a stronger or weaker magnet to locate a specific position on the wheel). Further, using a bi-dir Hall sensor or equivalent, the engine position may be maintained through shut-down, but during re-start alternative strategy may be used to assure that the engine is rotating in a forward direction.

FIG. 2 shows a schematic depiction of a cooling system 200 for an engine. It will be appreciated that the cooling system may be included in engine 10, shown in FIG. 1. The cooling system may be configured to remove heat from the engine. As discussed with greater detail herein, controller 12 may be configured to regulate the amount of heat removed from the engine via coolant circuit 250. In this way, the temperature of the engine may be regulated allowing the combustion efficiency to be increased as well as reducing thermal stress on the engine.

Cooling system 200 includes coolant circuit 250 traveling through a cylinder block 252. Water or another suitable coolant may be used as the working fluid in the coolant circuit. The cylinder block may include a portion of one or more combustion chambers. It will be appreciated that the coolant circuit may travel adjacent to the portions of the combustion chambers. In this way, excess heat generated during engine operation may be transferred to the coolant circuit.

A cylinder head 253 may be coupled to the cylinder block to form a cylinder assembly. When assembled, the cylinder assembly may include a plurality of combustion chambers.

The cylinder head may include an upper cooling jacket 254 and a lower cooling jacket 256. As shown, the upper cooling jacket includes an inlet 258 and the lower cooling jacket includes a plurality of inlets 260. However in other embodiments the lower cooling jacket may include a single inlet and the upper cooling jacket may include a plurality of inlets. Inlet 258 and inlets 260 are coupled to a common coolant circuit passage 261 in the cylinder block. In this way, the upper and lower cooling jackets receive coolant via their respective inlets from a common coolant sourced included in an engine block of the engine. However it will be appreciated that in some embodiments the upper and lower cooling jackets may receive coolant from different coolant passages in the engine block.

A first set of crossover coolant passages 262 may fluidly couple the upper cooling jacket to the lower cooling jacket. Likewise, a second set of crossover coolant passages 264 may additionally fluidly couple the upper cooling jacket to the lower cooling jacket.

Each crossover coolant passage included in the first set of crossover coolant passages may include a restriction 266. Various characteristics (e.g., size, shape, etc.) of the restrictions may be tuned during construction of cylinder head 253. Therefore, the restrictions included in the first set of crossover coolant passages may be different in size, shape, etc., than the restrictions included in the second set of crossover coolant passages and/or restriction 269. In this way, the cylinder head may be tuned for a variety of engines, thereby increasing the cylinder head's applicability. Although two crossover coolant passages are depicted in both the first and second sets of crossover coolant passages, the number of crossover coolant passages included in the first set and second sets of crossover coolant passages may be altered in other embodiments.

The crossover coolant passages allow coolant to travel between the cooling jackets at various points between the inlets and the outlets of both the upper and lower cooling jackets. In this way, the coolant may travel in a complex flow pattern where coolant moves between the upper and lower jackets, in the middle of the jacket and at various other locations within the jacket. The mixed flow pattern reduces the temperature variability within the cylinder head during engine operation as well as increases the amount of heat energy that may be removed from the cylinder head.

The upper cooling jacket includes an outlet 268. Outlet 268 may include a restriction 269. Additionally, the lower cooling jacket includes an outlet 270. It will be appreciated that in other embodiments outlet 270 may also include a restriction. The outlets from both the upper and lower cooling jackets may combine and be in fluidic communication. The coolant circuit may then travel through a radiator 272. The radiator enables heat to be transferred from the coolant circuit to the surrounding air. In this way, heat may be removed from the coolant circuit.

A pump 274 may also be included in the coolant circuit. A thermostat 276 may be positioned at the outlet 268 of the upper cooling jacket. A thermostat 278 may also be positioned at the inlet of the cylinder block. Additional thermostats may be positioned at other locations within the coolant circuit in other embodiments, such as at the inlet or outlet of the radiator, the inlet or outlet of the lower cooling jacket, the inlet of the upper cooling jacket, etc. The thermostats may be used to regulate the amount of fluid flowing through the coolant circuit based on the temperature. In some examples, the thermostats may be controlled via controller 12. However in other examples the thermostats may be passively operated.

It will be appreciated that controller 12 may regulate the amount of head pressure provided by pump 274 to adjust the flow-rate of the coolant through the circuit and therefore the amount of heat removed from the engine. Furthermore, in some examples controller 12 may be configured to dynamically adjust the amount of coolant flow through the upper cooling jacket via thermostat 276. Specifically, the flow-rate of the coolant through the upper cooling jacket may be decreased when the engine temperature is below a threshold value. In this way, the duration of engine warm-up during a cold start may be decreased, thereby increasing combustion efficiency and decreasing emissions.

Figure 3:
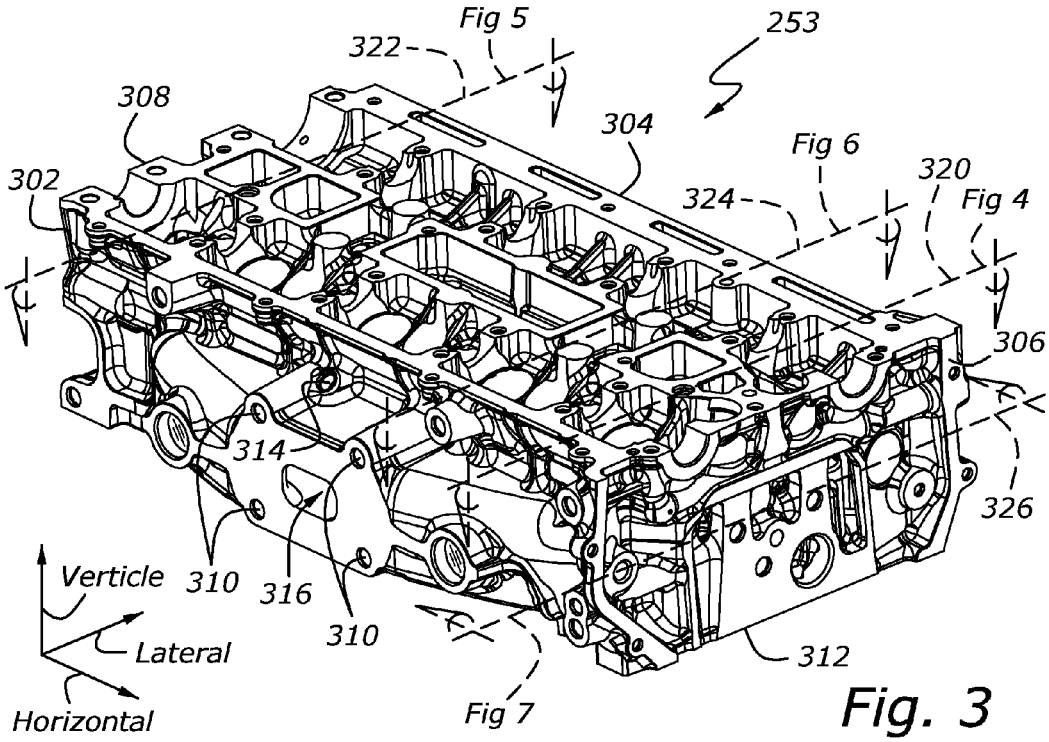
FIG. 3 shows an illustration of an example cylinder head drawn approximately to scale.

FIG. 3 shows a perspective view of an example cylinder head 253. The cylinder head may be configured to attach to a cylinder block (not shown) which defines one or more combustion chambers having a piston reciprocally moving therein. The cylinder head may be cast out of a suitable material such as aluminum. Other components of an assembled cylinder head have been omitted. The omitted components include a camshafts, camshaft covers, intake and exhaust valves, spark plugs, etc.

As shown, cylinder head 253 includes four perimeter walls. The walls include a first and a second side wall, 302 and 304 respectively. The four perimeter walls may further include a front end wall 306 and a rear end wall 308. The first side wall may include turbo mounting bolt bosses 310 or other suitable attachment apparatus configured to attach to a turbocharger. In this way, the turbocharger may be mounted directly to the cylinder head reducing losses within the engine. The turbocharger may include an exhaust driven turbine coupled to a compressor via a drive shaft. The compressor may be configured to increase the pressure in the intake manifold.

A bottom wall 312 may be configured to couple to the cylinder head (not shown) thereby forming the engine combustion chambers, as previously discussed. The cylinder head may further include a de-gas port 314 including a valve configured to remove gas from the upper cooling jacket. In this way, the amount of gas in both the upper and lower cooling jacket may be reduced. The de-gas port is positioned in an area adjoining an upper surface of the upper cooling jacket. In some examples, the de-gas port may be positioned at a crest (e.g., substantially highest vertical point) in the upper cooling jacket. However in other examples, the de-gas port may be positioned in another suitable location. The de-gas port may decrease the amount of gas (e.g., air and/or water vapor) in both the upper and lower cooling jacket, thereby increasing operating efficiency of the upper and lower cooling jackets.

Figure 4:
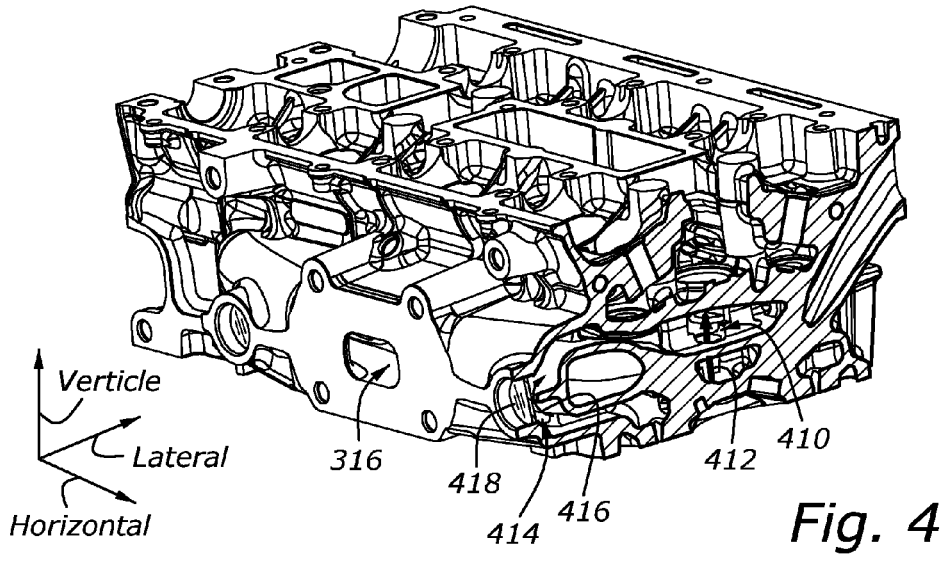
FIGS. 4-7 show various cut-away views of the example cylinder head shown in FIG. 3 drawn approximately to scale.

Cylinder head 253 may further include an exhaust manifold 316 to which a plurality of runners are coupled. The runners are illustrated and discussed in more detail with regard to FIGS. 8-16. The runners may be coupled to the exhaust valves for each combustion chamber. In this way, the exhaust manifold and runners may be integrated into the cylinder head casting. The integrated runners have a number of benefits, such as reducing the number of parts within the engine thereby reducing cost throughout the engine's development cycle. Furthermore, inventory and assembly cost may also be reduced when an integrated exhaust manifold is utilized. Cutting plane 320 defines the cross-section shown in FIG. 4 and cutting plane 322 defines the cross-section shown in FIG. 5. Furthermore, cutting plane 324 defines the cross-section shown in FIG. 6 and cutting plane 326 defines the cross-section shown in FIG. 7. FIG. 4 shows a cut-away view of cylinder head 253 shown in FIG. 3. A first crossover coolant passage 410 is shown. The first crossover coolant passage 410 may be included in the first set of crossover coolant passages 262 shown in FIG. 2. Continuing with FIG. 4, arrow 412 denotes the general path of the fluid traveling through the first crossover coolant passage from the lower cooling jacket to the upper cooling jacket. As shown the coolant travels in a substantially vertical direction through a vertically aligned passage, relative to vertical piston motion of pistons in the cylinder. It will be appreciated that the width of the first crossover coolant passage may be altered during construction via machining. In this way, the crossover coolant passage may be tuned to a desired specification.

The first set of crossover coolant passages may be radially aligned with two or more cylinders included in the engine. It will be appreciated that the alignment may be about a single line of symmetry. The first set of crossover coolant passages may be also spaced away from the inlet and/or exhaust ports in the engine. Positioning the first set of crossover coolant passages in alignment with two or more cylinder and away from the inlet and/or exhaust ports enables the structural integrity of the cylinder head to be increased when compared to crossover coolant passages that may be positioned adjacent to inlet or exhaust ports which may decrease the thickness of the metal surrounding the exhaust valve, thereby increasing the likelihood of exhaust or intake valve failure. Furthermore, a larger diameter flow channel may be utilized when the crossover flow channels are aligned in this way when compared to crossover coolant channels that are positioned adjacent to intake or exhaust valves.

A second crossover coolant passage 414 is also shown. The second crossover coolant passage 414 may be included in the second set of crossover coolant passages 264 shown in FIG. 2. The second crossover coolant passage is adjacent to a periphery of the cylinder head and spaced away from the exhaust manifold 316. Therefore it will be appreciated that the second set of crossover coolant passages may be adjacent to a periphery of the cylinder head and spaced away from the exhaust manifold. Arrow 416 denotes the general path of the fluid traveling through the first crossover coolant passage from the lower cooling jacket to the upper cooling jacket. As shows cup 418 both directs and restricts flow through the first crossover coolant passage. The flow pattern of the coolant through the second set of crossover coolant passages follows an arc. When a cup is used to direct the flow of coolant through the second crossover coolant passage, this enables the construction process (e.g., machining) of the cylinder head to be simplified.

Figure 5:
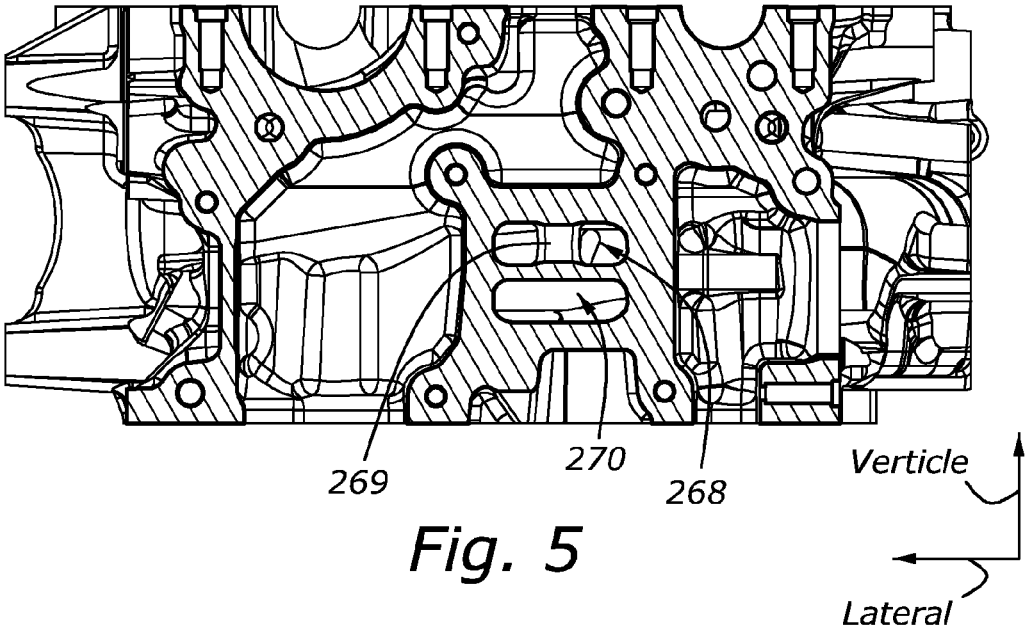

FIG. 5 shows an example outlet 268 of the upper cooling jacket and an example outlet 270 of the lower cooling jacket. As depicted, outlet 268 includes a restriction 269 positioned in the center of the inlet. However it will be appreciated that other alignments are possible in other embodiments.

Figure 6:
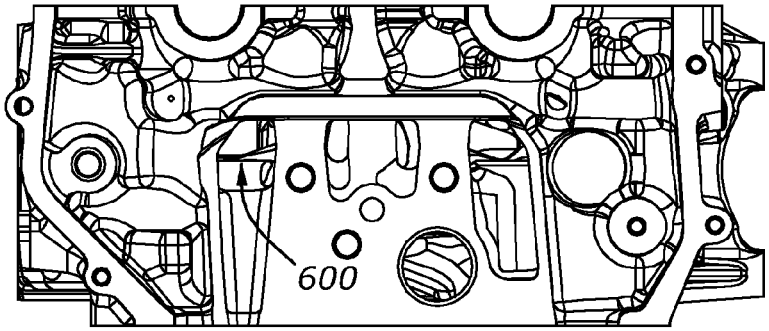

FIG. 6 shows an oil drain passage 600 that is positioned in a depressed portion of the cylinder head and adjacent to front end wall 306. It will be appreciated that the oil drain passage may be separated from the coolant circulating in the upper and lower cooling jackets. The oil drain passage may be coupled to an oil reservoir included in an engine lubrication system. It will be appreciated that the oil reservoir may include a lift pump configured to circulate oil within the engine lubrication system. Additional oil drain passages may also be included in the cylinder. Additional features of oil drain passage 600 are illustrated with regard to FIG. 7.

Figure 7:
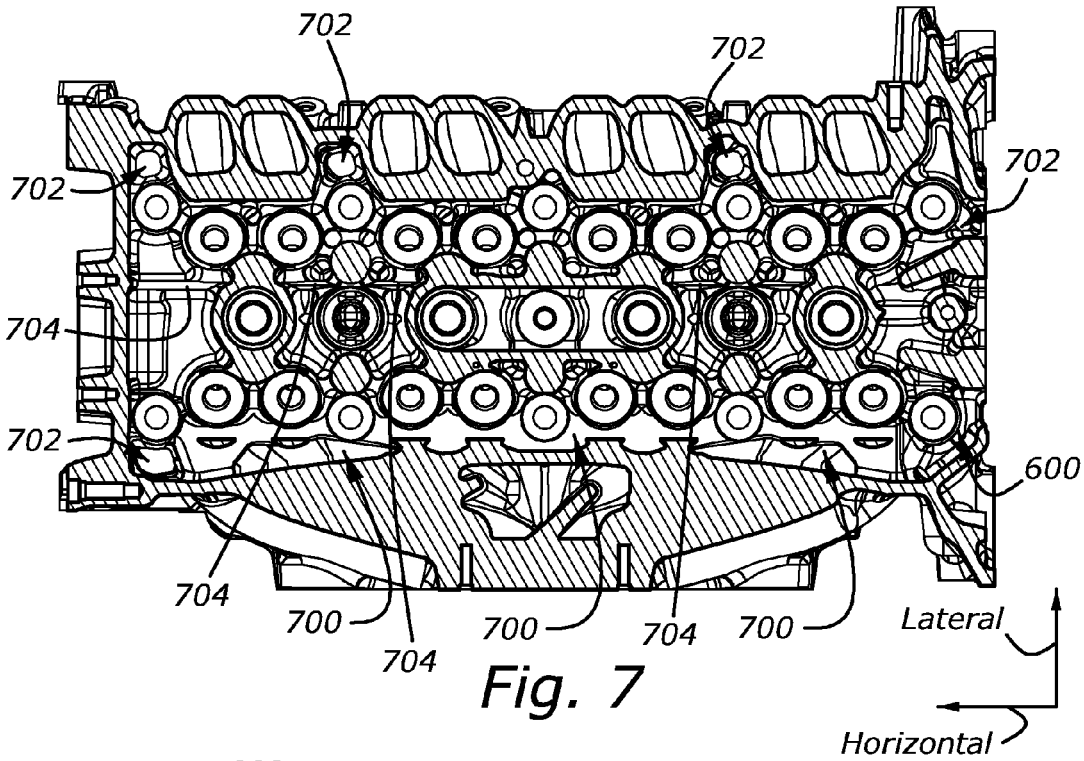
Figure 8:
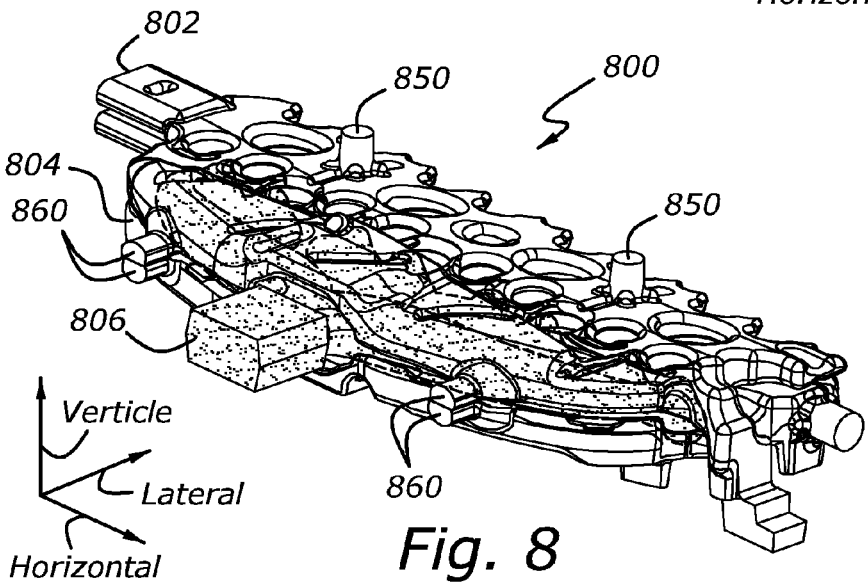
FIGS. 8-16 show various views of a composite core used to cast the cylinder head shown in FIG. 3 drawn approximately to scale.

FIG. 7 shows a top view of the oil drain passage 600 shown in FIG. 6. As shown, an oil drain channel 700 may extend across the horizontal length of the cylinder head. It will be appreciated that the oil drain passage may be positioned vertically below the oil drain channel. In this way, the oil drain channel may passively direct oil to the oil drain passage 600.

The horizontal surface "floor" of the oil drain channel 700 is sloped in the horizontal direction toward the front and rear oil drain passages 702. It will be appreciated that oil drain passage 600 shown in FIG. 6 is one of the oil drain passages 702 shown in FIG. 7. The highest point in oil drain channel 700 may be positioned proximate to the mid-distance from both the front and rear oil drain passages.

The horizontal surface "floor" of the oil drain channel 700 is inclined to maintain zero tilt of the floor in the lateral direction at engine installation angle in the vehicle. Additionally the oil drain channel's core surface vertical wall on the outside is curved toward the oil drain passages 702 with the curvatures crest residing near the mid-point between the oil drain passages 702 to allow oil drain flow balance.

The intake side of the oil drain channel 700 includes a dividing wall 704 used to control oil drain passages 702 oil flow on the intake side. The intake side floor of oil channel 700 is inclined at engine installation angle in the vehicle, so intake side drain oil will run towards the oil drain passages 600 on the intake side.

FIGS. 8-12 show illustrations of a composite core 800 that may be used to construct (e.g., cast) cylinder head 253 shown in FIG. 3. The core prints may enable clearer visualization of coolant passages in the upper and lower cooling jackets, as well as the exhaust runners, and the shape of the core prints represents the shape of the coolant passage, and relative positioning with respect to each other, in the cylinder head 253. The composite core includes an upper core 802, a lower core 804, and an exhaust manifold port core 806. As shown, the vertically aligned protrusions 850 included in both the upper and lower core may define the first set of crossover coolant passages 262. It will be appreciated that the crossover coolant passages may be vertically orientated relative to piston motion. The laterally aligned extensions 860 in both the upper and lower core may define the second set of crossover coolant passages 264. It will be appreciated that horizontally aligned extension 862 may define outlet 268 of the upper cooling jacket including restriction 269.

Figure 9:
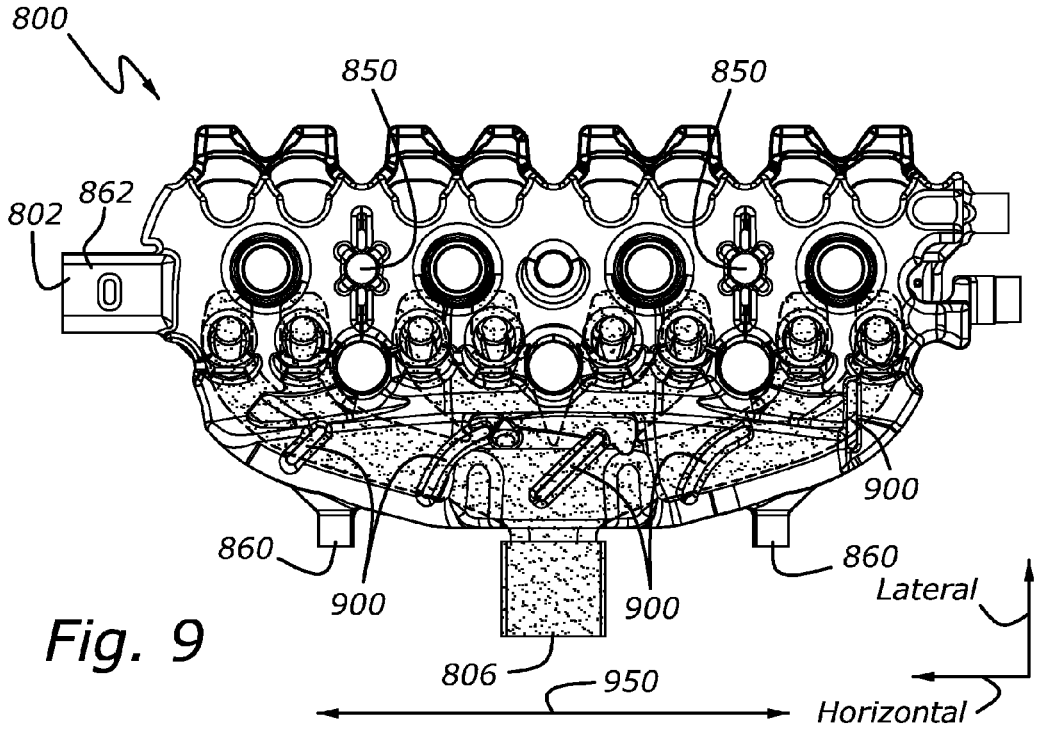
Figure 10:
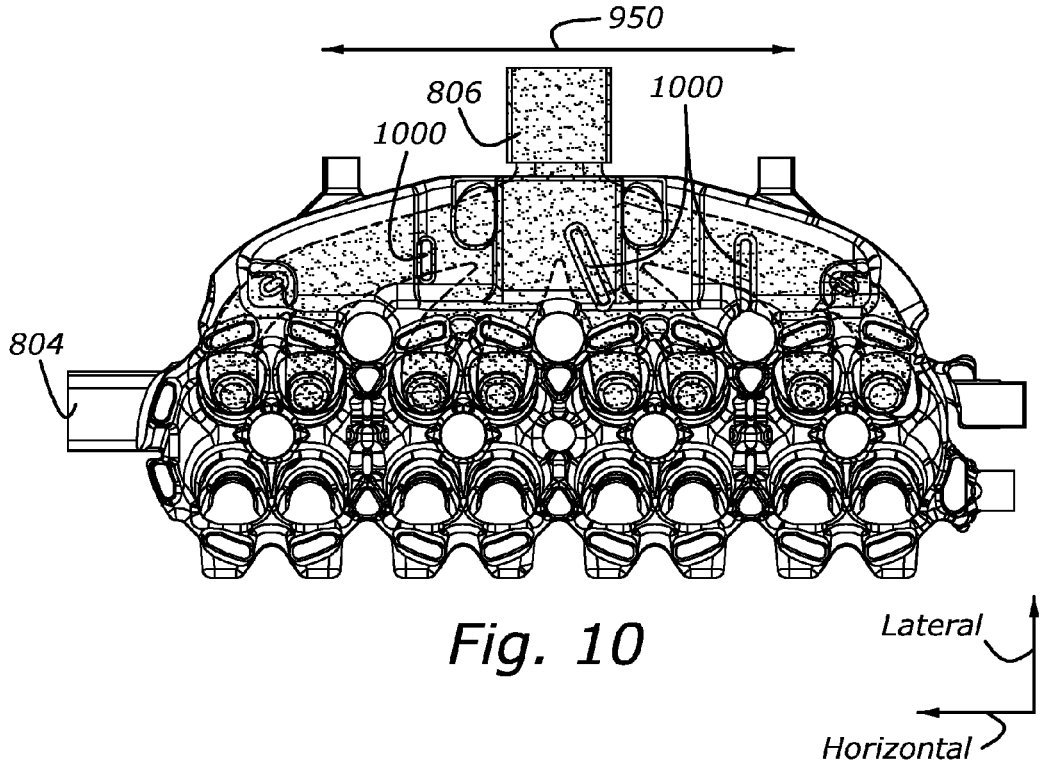

FIG. 9 shows a top view of upper core 802 and FIG. 10 shows a bottom view of lower core 804. It will be appreciated that the upper core may define a plurality of vertically aligned ribs 900 in the upper cooling jacket. The vertically aligned ribs may be positioned around the exhaust manifold. Likewise the lower core may define a plurality of vertically aligned ribs 1000 in the lower cooling jacket. The vertically aligned ribs 900 and 1000 may create a flow pattern that is conducive to the transfer of heat from the exhaust manifold and exhaust runners to the upper and lower cooling jackets. The ribs may also increase the structural integrity of the upper and lower cooling jackets. As discussed above with regard to FIG. 8 horizontally aligned extension 862 defines outlet 268 of the upper cooling jacket including restriction 269.

As shown the vertically aligned ribs 900 included in the upper cooling jacket may be positioned at an angle between 25 degrees and 75 degrees with respect a horizontal axis 950 of the cylinder head. Similarly vertically aligned ribs 1000 in the lower cooling jacket may be positioned at an angle between 25 and 75 degrees with respect to horizontal axis 950.

As depicted, a portion of the vertical ribs may be curved. The curvature may reduce the turbulence within the coolant around the exhaust manifold. However in other embodiments the vertically aligned ribs 900 may be substantially straight.

Subsequent figures (e.g., FIGS. 18 and 19) depict the general desired flow pattern within the upper and lower coolant jackets included in the cylinder head. Ribs 1000 due to the nature of the turbo charger bolt holes redirect flow of the coolant. Ribs 900 both redirect flow and cause impingement of the redirected flow at a high heat flux zone. The high heat flux zone within the integrated exhaust manifold section of the cooling jackets is located at or near the outlet flange of the exhaust manifold. The curved ribs may have a similar geometry to an air foil section. The curved ribs are configured to redirect coolant flow and impinge that redirected flow. The straight ribs may not have the ability to redirect as much flow when compared to the curved ribs. Additionally, flow around the straight ribs may slip (e.g., experience flow separation) which may not provided in the desired impingement in certain areas of the cooling jackets. Therefore, a portion of the ribs are curved to provide the desired amount of impingement and redirection. The inlet and exit angle of the curved ribs may be adjusted to control both the amount of redirected flow and its subsequent impingement velocity.

Ribs 900 emanate from the outer exhaust runners and proceed to an overhang adjacent to an exhaust port. The distance from ribs 900 to the outer jacket may be between 11 millimeters (mm) and 12 mm. However other separations are possible. This dimension may correspond to the local thickness of the cooling jacket core that blankets the outermost portion of the exhaust ports. The ribs may emanate from just beyond the cooling jacket that surrounds the exhaust runners in that the upper cooling jacket increase in thickness above the integrated exhaust ports.

Ribs 900 and 1000 may completely or partially block the coolant flow in the upper and lower cooling jackets. In other words the ribs may vertically span the cooling jackets or may only vertically extend across a portion of the cooling jackets. In some examples, the ribs may at least partially extend (e.g., extend halfway) across a portion of the cooling channels. The ribs that partially block the cooling channels may decrease the speed of the coolant acting as a speed bump.

Ribs 1000 may emanate in a similar fashion to those of ribs 900. As stated above they do not extend outboard to an overhang adjacent to the exhaust ports as those of ribs 900. The length of ribs 1000 may be determined by the amount of bulk coolant flow in the lower versus upper cooling jackets and velocities that may be needed to sustain a desired amount local heat fluxes. It will be appreciated that the desired heat flux and other engine cooling requirements may be determined based on the heat tolerances of various engine componentry, such as the cylinder head, intake and exhaust valves, fuel injector, etc.

Figure 11:
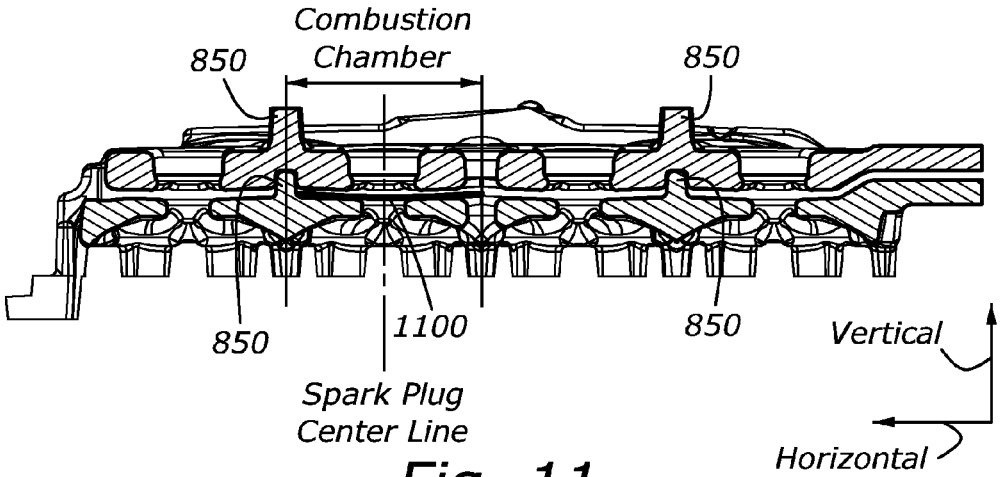

FIG. 11 shows a cut-away side view of composite core 800. As shown the contour 1100 of the mid-deck wall separating the upper cooling jacket from the lower cooling jacket may be curved about the center line of a combustion chamber to increase cylinder head stiffness. However in other examples, the contour of the mid-deck wall may be substantially flat.

Figure 12:
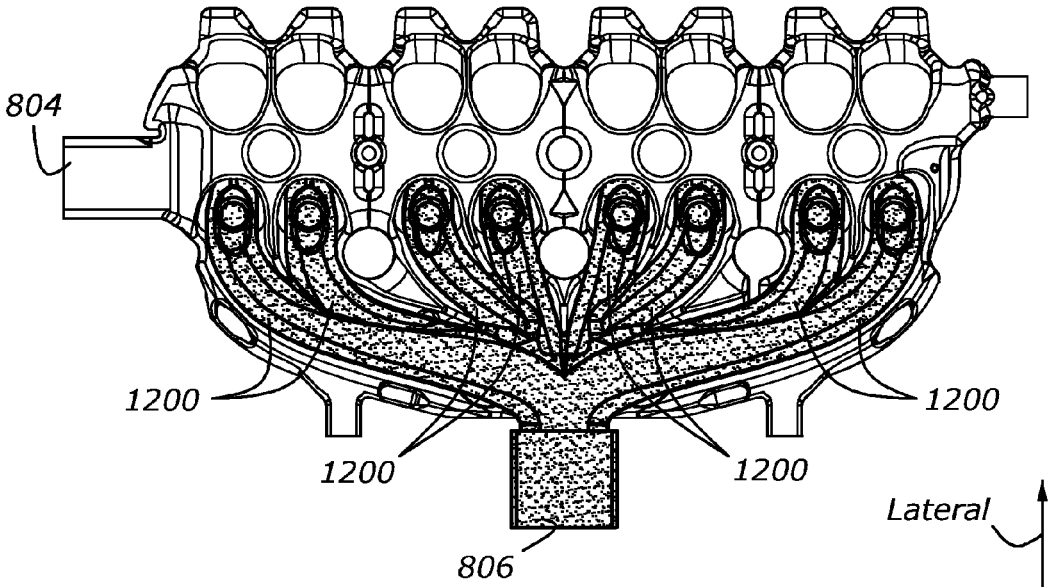

FIG. 12 shows a top view of the lower core 804 and the exhaust manifold port core 806. The exhaust manifold port core defines a plurality of runners 1200. The path of the runners is curved to decrease flow separation in the exhaust gas. As previously discussed the runner are coupled to the exhaust valves of a plurality of cylinders. It will be appreciated that the lower cooling jacket may at least partially surround the exhaust runners and corresponding exhaust ports included in the cylinder head Likewise, the upper cooling jacket may at least partially surround the exhaust ports and exhaust runners included in the cylinder head.

Figure 13:
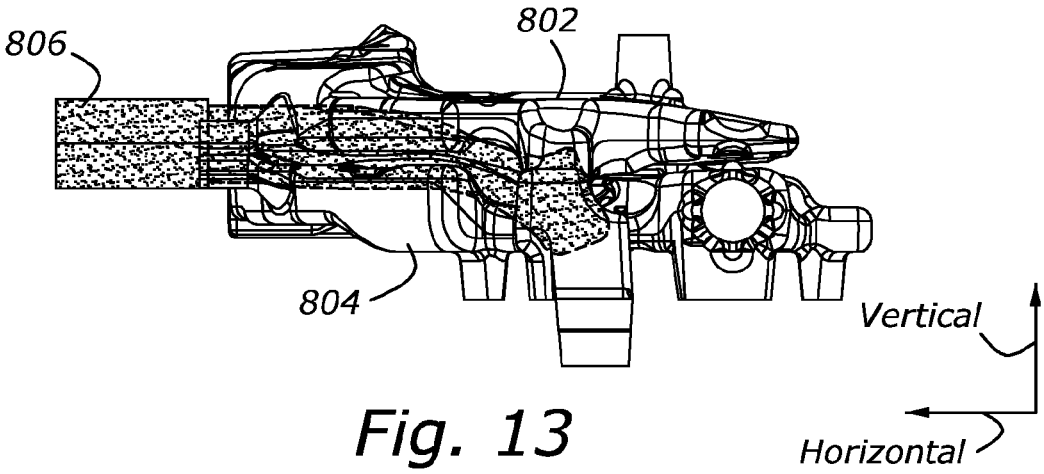
Figure 14:
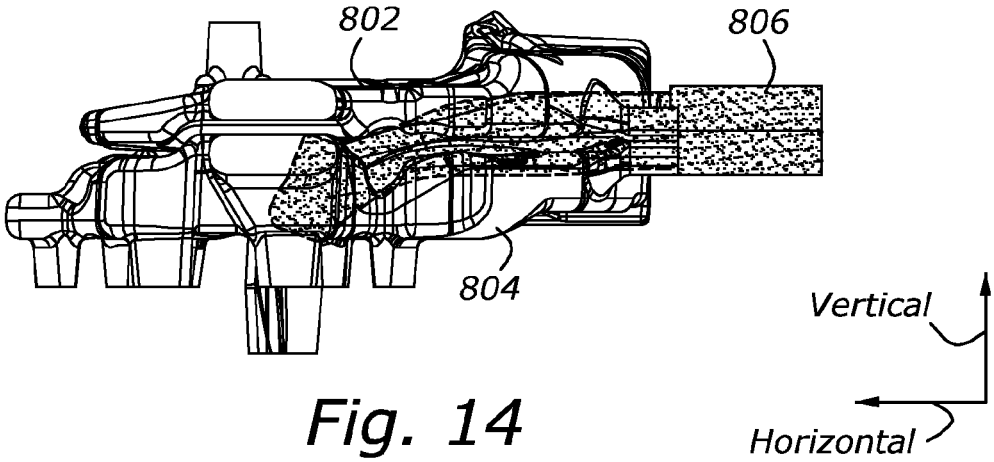

FIGS. 13 and 14 show opposing side views of composite core 800. FIGS. 15 and 16 show a front and back view of composite core 800.

FIGS. 17-19 show various flow diagrams of the fluid within the upper and lower cooling jackets. Although core prints are shown, it will be appreciated that the coolant may travel through passages defined by the core prints during casting. Arrows 1700 denotes the general direction of the coolant traveling into the inlets of the lower cooling jacket. As shown the coolant traveling into the inlets of the lower cooling jacket is in a substantially vertical direction. Arrow 1702 denotes the general direction of the coolant traveling out of the outlet of the lower cooling jacket. As shown the coolant is travelling out of the outlet in a substantially horizontal direction. Arrows 1704 denote the general direction of the coolant traveling into the inlet of the upper cooling jacket. As shown the coolant is traveling into the inlet in a substantially vertical direction. Arrow 1706 denotes the fluid traveling out of the outlet of the upper cooling jacket. As shown the coolant is traveling out of the outlet in a substantially horizontal direction.

FIG. 18 shows a top view of lower core 804. Arrows 1800 denote the general direction of the coolant flowing through the lower cooling jacket. It will be appreciated that the coolant may travel into the upper cooling jacket through the crossover coolant passages at points 1802.

Exhaust port bridges 1804 may be drilled into the cylinder head during construction. In some embodiments the exhaust port bridges run between the exhaust ports of one or more combustion chambers. The exhaust port bridges run from the mid-deck wall to close proximity to the combustion chamber center. The center of the combustion chamber may contain a spark plug and/or an injector mounting apparatus. The drilled passage may have a cast feature or machined feature that provides a flat surface that is perpendicular to the drill direction to provide a drill spot face. The exhaust port bridges may be configured to direct coolant between the exhaust ports thereby increasing the amount of heat that may transferred to the coolant fluid in the lower cooling jacket from the exhaust ports.

FIG. 19 shows a top view of upper core 802. Arrows 1900 denote the general direction of the coolant flowing through the upper cooling jacket. It will be appreciated that the coolant may travel into the upper cooling jacket through the crossover coolant passages at points 1902. The mixed flow pattern shown in FIGS. 17-19 reduces thermal variability, thereby reducing stress on the cylinder head and/or engine block and decreasing the likelihood of the cylinder head and/or engine block warping during cool-down. Additionally, the flow pattern shown in FIGS. 17-19 allows a greater amount heat to be removed from the engine when compared to dual cooling jacket designs that use a parallel or a series configuration. In this way, engine operation may be improved and the likelihood of thermal degradation of the cylinder head as well as other engine components (e.g., the exhaust manifold, emission controls system, etc.) may be decreased via the reduction in temperature of the cylinder head and the surrounding components. It will be appreciated that the flow patterns depicted in FIGS. 17-19 are exemplary in nature and that an upper and lower cooling jacket with alternate flow patterns may be used in other embodiments.

Figure 20:
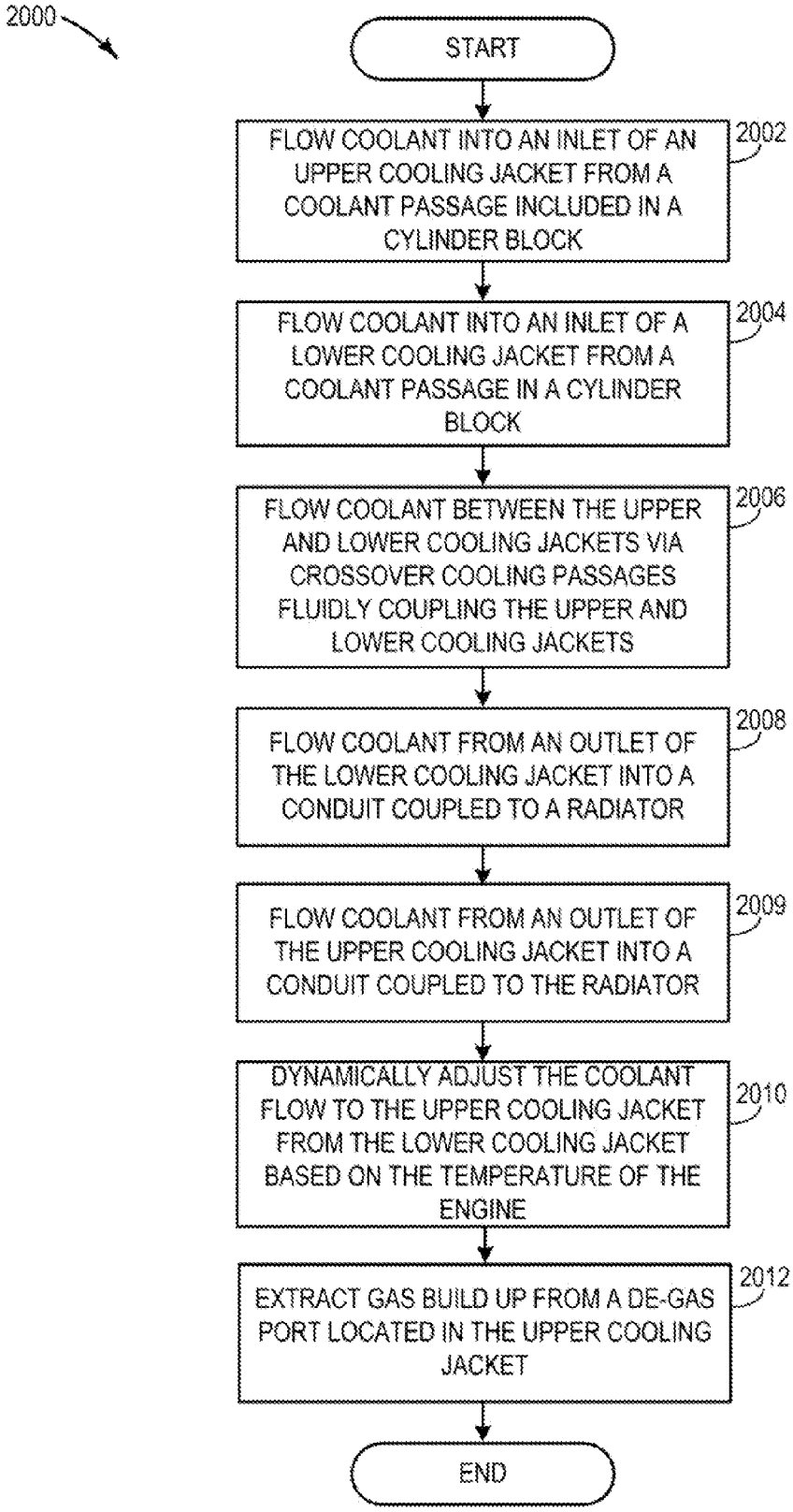
FIG. 20 shows a method for operation of a cooling system in an engine.

FIG. 20 shows a method 2000 for operation of a cooling system in an internal combustion engine. The method may be implemented by the system, components, etc., described above or alternatively may be implemented via other suitable systems, components, etc.

First at 2002 the method includes flowing coolant into an inlet of an upper cooling jacket from a coolant passage included in a cylinder block. Next at 2004 the method includes flowing coolant into an inlet of a lower cooling jacket from a coolant passage in a cylinder block.

In some examples, the inlet of the upper cooling jacket and the inlet of the lower cooling jacket may receive coolant from a common coolant passage in the cylinder block. However, in other embodiments, the inlet of the upper cooling jacket and the inlet of the lower cooling jacket may receive coolant from different coolant passages in the cylinder block.

Next at 2006 the method includes flowing coolant between the upper and lower cooling jackets via a plurality of crossover coolant passages fluidly coupling the upper and lower cooling jackets. In some examples, the plurality of crossover coolant passages may be included in the first and/or the second set of crossover coolant passages discussed above. In this way, the coolant may travel in a mixed flow pattern between the upper and lower cooling jackets, thereby decreasing thermal variability within the cylinder head.

At 2008 the method includes flowing coolant from an outlet of the lower cooling jacket into a conduit coupled to a radiator. At 2009 the method includes flowing coolant from an outlet of the upper cooling jacket into a conduit coupled to the radiator.

At 2010 the method may include dynamically adjusting the coolant flow to the upper cooling jacket from the lower cooling jacket based on the temperature of the engine. It will be appreciated that in some examples coolant flow may be dynamically restricted when the engine temperature is below a threshold value and subsequently increased when the engine temperature is above the threshold value. In this way, the engine may be heated more quickly during a cold start, thereby increasing combustion efficiency and decreasing emissions. At 2012 the method may include extracting gas build up from a de-gas port located in the upper cooling jacket. However in other examples steps 2010 and 2012 may not be included in method 2000.

It will be appreciated that the configurations and/or approaches described herein are exemplary in nature, and that these specific embodiments or examples are not to be considered in a limiting sense, because numerous variations are possible. The subject matter of the present disclosure includes all novel and nonobvious combinations and subcombinations of the various features, functions, acts, and/or properties disclosed herein, as well as any and all equivalents thereof.

The invention claimed is:

1. A cylinder head for an engine comprising:

an upper cooling jacket including at least a first inlet and a first outlet;

a lower cooling jacket including at least a second inlet and a second outlet; and a first set of crossover coolant passages fluidly coupled between the upper cooling jacket and the lower cooling jacket and adjacent to one or more combustion chambers.

2. The cylinder head of claim 1, wherein the first set of crossover coolant passages are positioned in radial alignment with one or more combustion chambers included in the engine.

3. The cylinder head of claim 1, further comprising a second set of crossover coolant passages fluidly coupled between the upper cooling jacket and the lower cooling jacket and adjacent to a periphery of the cylinder head and spaced away from an exhaust manifold.

4. The cylinder head of claim 1, further comprising a de-gas port configured to remove gas from the upper cooling jacket, the de-gas port positioned in an area adjoining an upper surface of the upper cooling jacket.

5. The cylinder head of claim 1, further comprising at least one oil drain passage positioned in a depressed portion of the upper cooling jacket.

6. The cylinder head of claim 1, further comprising a turbo mounting bolt boss positioned adjacent to an exhaust manifold and configured to attach to a turbocharger.

7. The cylinder head of claim 6, wherein the upper and lower cooling jackets circulate coolant around the turbo mounting bolt boss.

8. The cylinder head of claim 1, wherein the first set of crossover coolant passages are radially aligned with two or more combustion chambers of the engine.

9. The cylinder head of claim 1, wherein the upper and lower cooling jackets receive coolant via their respective inlets from a common coolant source included in an engine block of the engine.

10. The cylinder head of claim 1, wherein the first set of crossover coolant passages are spaced away from an exhaust manifold.

11. The cylinder head of claim 1, wherein a portion of a mid-deck wall separating the upper cooling jacket from the lower cooling jacket is curved.

12. The cylinder head of claim 1, wherein the upper and lower cooling jackets include vertically positioned ribs adjacent to an exhaust manifold.

13. A method for a cooling system in an engine, comprising:

flowing coolant into an inlet of an upper cooling jacket from a coolant passage in a cylinder block;

flowing coolant into an inlet of a lower cooling jacket from the coolant passage in the cylinder block, the lower cooling jacket inlet separate from the upper cooling jacket inlet; and flowing coolant between the upper and lower cooling jackets via a crossover coolant passage in a cylinder head, the crossover coolant passage fluidly coupling the upper and lower cooling jackets, the crossover coolant passage positioned downstream of the inlets of the upper and lower cooling jackets.

14. The method according to claim 13, further comprising extracting gas build up from a de-gas port located in the upper cooling jacket.

15. The method according to claim 13, further comprising dynamically adjusting the coolant flow to the upper cooling jacket from the lower cooling jacket based on the temperature of the engine.

16. The method according to claim 15, wherein the coolant flow is dynamically restricted when the engine temperature is below a threshold value.

17. The method according to claim 16, wherein the coolant flow is increased when the engine temperature is above the threshold value.

18. A cylinder head for an engine comprising:

an intake manifold coupled to a plurality of exhaust runners;

an upper cooling jacket at least partially surrounding one or more exhaust ports and exhaust runners, the upper cooling jacket including at least a first inlet and a first outlet;

a lower cooling jacket at least partially surrounding the one or more exhaust ports and exhaust runners, the lower cooling jacket including at least a second inlet and a second outlet;

a first set of crossover coolant passages fluidly coupled between the upper cooling jacket and the lower cooling jacket and adjacent to one or more combustion chambers, the crossover coolant passages positioned in a substantially vertical orientation relative to piston motion; and a second set of crossover coolant passages fluidly coupled between the upper cooling jacket and the lower cooling jacket, the second set of crossover coolant passages spaced away from the first set of crossover coolant passages and the intake manifold and adjacent to a periphery of the cylinder head.

19. The cylinder head of claim 18, wherein the first set of crossover coolant passages are positioned in radial alignment with one or more combustion chambers included in the engine.

20. The cylinder head of claim 18, wherein at least one of the crossover coolant passages included in the first set of crossover coolant passages and the second set of crossover coolant passages includes a tuned restriction.

* * * * *